United States Patent [19]

Wessel et al.

[11] 4,306,534

[45] Dec. 22, 1981

[54] APPARATUS FOR CONTROLLING THE RATIO OF AIR TO FUEL QUANTITY IN INTERNAL COMBUSTION ENGINES

[75] Inventors: Wolf Wessel, Oberriexingen; Ludwig Walz, Stuttgart, both of Fed. Rep. of Germany

[73] Assignee: Robert Bosch GmbH, Stuttgart, Fed. Rep. of Germany

[21] Appl. No.: 126,066

[22] Filed: Feb. 29, 1980

[30] Foreign Application Priority Data

Mar. 3, 1979 [DE] Fed. Rep. of Germany ..... 2908386

[51] Int. Cl.[3] ..... F02M 25/06

[52] U.S. Cl. ..... 123/571; 123/568

[58] Field of Search ..... 123/571, 568, 569

[56] References Cited

U.S. PATENT DOCUMENTS

| | | | |
|---|---|---|---|
| 4,100,891 | 7/1978 | Williams | 123/571 |
| 4,157,081 | 6/1979 | Wake et al. | 123/571 |
| 4,208,995 | 6/1980 | Simko et al. | 123/571 |
| 4,257,381 | 3/1981 | Yuzawa et al. | 123/571 |

FOREIGN PATENT DOCUMENTS

| | | | |
|---|---|---|---|
| 2750470 | 5/1979 | Fed. Rep. of Germany | 123/571 |
| 54-137521 | 10/1979 | Japan | 123/571 |
| 54-155315 | 12/1979 | Japan | 123/571 |
| 2012000 | 7/1979 | United Kingdom | 123/571 |

*Primary Examiner*—Wendell E. Burns
*Attorney, Agent, or Firm*—Edwin E. Greigg

[57] ABSTRACT

An apparatus is proposed which serves to control the ratio of air to fuel quantity of the operational mixture to be introduced into the combustion chambers of an internal combustion engine. The actual fuel quantity supplied via an injection apparatus (2) and the actual air quantity supplied via the intake manifold of the engine are measured and processed in a control apparatus (21) into a correction adjusting variable. The apparatus further functions with exhaust recirculation, with the aspirated fresh air quantity being dosed and the remnant filling of the gaseous filling introduced into the combustion chambers of the engine is replaced by recirculated exhaust gas. For the purpose of dosing the fresh air, a symmetrical throttle valve (14) is disposed in the intake manifold, whose position is transferred by means of pneumatic servomotor (23) to a second throttle device (12, 32), by means of which finally the quantity of the recirculated exhaust gas is determined.

6 Claims, 2 Drawing Figures

APPARATUS FOR CONTROLLING THE RATIO OF AIR TO FUEL QUANTITY IN INTERNAL COMBUSTION ENGINES

BACKGROUND OF THE INVENTION

The invention relates to an apparatus which serves to control the ratio of air to fuel quantity of the operational mixture to be introduced into the combustion chambers of an internal combustion engine. In a known apparatus of this kind, the quantity adjustment member of a fuel injection pump is actuated in accordance with the correction signal. Acting as a guide value for the control apparatus is an adjustable stop which limits the deflection of a baffle plate within a portion of an intake manifold which narrows opposite the flow direction in the manner of a funnel. The baffle plate, which is adjustable in this intake manifold portion by means of differential pressure, serves in combination with a constant restoring force as an air flow rate meter by means of which a fuel metering cross section is adjusted in accordance with the aspirated air quantity. The comparison of a set-point fuel quantity, corresponding to this fuel metering cross section, with the actual fuel quantity adjusted at the fuel injection pump by means of the quantity adjusting device takes place by hydraulic means, with the position of the quantity adjusting device being corrected in accordance with the result of comparison. Downstream from the baffle plate there is a throttle valve in the intake manifold which is adjustable by the pressure prevailing between the throttle valve and the baffle plate on the one side and the pressure prevailing upstream of the baffle plate on the other side, counter to the force of the restoring spring. When the throttle valve is opened, the entry of an exhaust recirculation line is kept closed by the valve with its portion located downstream of the throttle valve shaft. The prior art apparatus has the disadvantage that in order to adjust the load an intervention must be made at the air flow rate meter, and this intervention must be performed counter to the forces, which are not insignificant, acting on the baffle plate, especially in the case of reducing the load. Furthermore, a correction intervention is made on the fuel side where small errors have a very great effect on the resulting composition of the exhaust.

OBJECT AND SUMMARY OF THE INVENTION

The apparatus according to the invention which serves to control the ratio of air fuel quantity of the operational mixture to be introduced into the combustion chambers of an internal combustion engine has the advantage over the prior art that the adjustment of fresh air quantity can be accomplished virtually force-free with the aid of the throttle valve according to the invention. As a result of the features disclosed in the present invention, advantageous further embodiments of and improvements to the apparatus which serves to control the ratio of air fuel quantity of the operational mixture to be introduced into the combustion chambers of an internal combustion engine are possible. It is particularly advantageous that a valve closing member cooperating with the mouth of the exhaust recirculation line, acting as the valve seat, serves as the throttle device and has the form of a plate valve which is urged in the closing direction by the pressure in the exhaust recirculation line.

As a result of this embodiment, there is achieved the advantage that the exhaust gas counter pressure may substantially be used as the sealing force acting on the valve closing member. The disposition of a symmetrical throttle valve upstream of the mouth of the exhaust recirculation line offers the advantage that first the throttle valve can be adjusted with a very small expenditure of force, so that a correction adjustment can also be made without a great amount of additional force, in the context of a closed control loop, and second that the throttle valve remains free of soiling which could limit its function.

The invention will be better understood and further objects and advantages thereof will become more apparent from the ensuing detailed description of preferred embodiments taken in conjunction with the drawings.

DETAILED DESCRIPTION OF THE PREFERRED EMBODIMENTS

Figure 1:
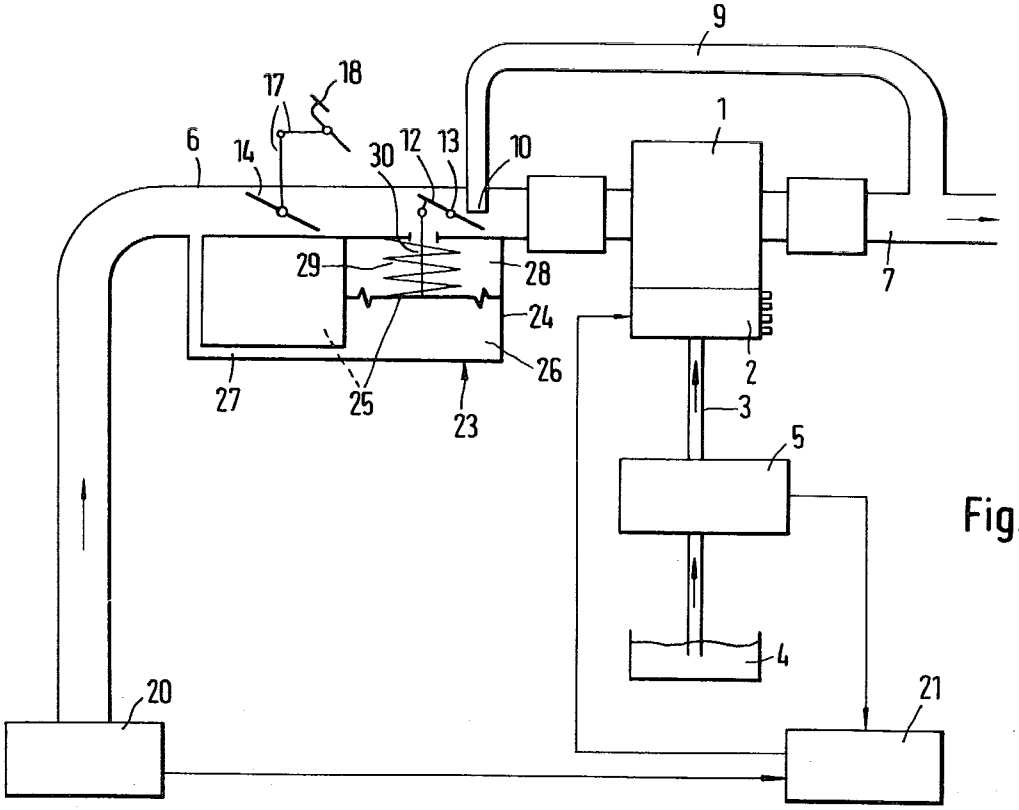
FIG. 1 shows a first exemplary embodiment with an arbitrarily actuatable, symmetrical throttle valve.

In the exemplary embodiment of FIG. 1, an internal combustion engine 1 is shown in simplified form, which is supplied with fuel by a fuel injection pump 2. The fuel injection pump 2 is supplied with fuel via a fuel supply line 3 from a fuel supply container 4, and the supplied fuel quantity, which then also proceeds to injection into the engine, is measured with the aid of a fuel quantity meter 5 disposed in the fuel supply line 3. In a conventional manner, the engine 1 has an air intake line 6 and an exhaust manifold 7. From the exhaust manifold 7, an exhaust recirculation line 9 leads to the air intake line 6 and in the example of FIG. 1 protrudes freely into the air intake line 6. The mouth 10 of the exhaust recirculation line 9 is located in the pivotal range of a second throttle valve 12, by means of the throttle valve half of which located downstream of the throttle valve shaft 13 the mouth 10 of the exhaust recirculation 9 is closed when this throttle valve half is opened relative to the air intake line cross section. Upstream of the second throttle valve 12 is a first, symmetrical throttle valve 14, which is actuatable via a rod 17. In FIG. 1 the rod 17 is connected with the gas pedal 18 by way of which the torque intention of the driver is indicated. Upstream of the first throttle valve 14 and the air intake line 6 is an air flow rate meter 20, which furnishes a control apparatus 21. The control apparatus 21 is furthermore connected with the fuel quantity meter 5 and compares both furnished values relative to a fuel-air mixture which is to be maintained. The control apparatus 21 may function electrically or hydraulically as well, which depends especially upon the type of quantity meter which is used. The acutal air quantity signal can be converted in the control device in a known manner into a set-point fuel quantity signal and compared with the acutal fuel quantity signal. The correction control signal resulting from the result of comparison is used, in the illustrated exemplary embodiment, for the purpose of correcting the quantity adjusting device (not further shown) of the fuel injection pump. This adjustment can also be effected either mechanically or electromechanically.

The second throttle valve is actuated with the aid of a pneumatic servomotor 23, in the housing 24 of which an adjusting diaphragm 25 is fastened in a tight manner. The adjusting diaphragm 25 encloses on one side a first pressure chamber 26 in the housing 24 which communicates via a line 27 with the air intake line 6 upstream of the first throttle valve 14, preferably with an area of the air intake line between the throttle valve 14 and the air flow rate meter 20. On the other said of the adjusting diaphragm 25, the diaphragm encloses a second pressure chamber 28, in which a compression spring 29 is disposed which acts upon the adjusting diaphragm 25. A rod 30 is firmly connected to the adjusting diaphragm 25 and leads to the shaft 13 of the second throttle valve and adjusts it in such a manner that the shaft 13, solely under the influence of the compression spring 29, moves into a position in which the cross section of the air intake line 6 is opened and the mouth of the exhaust recirculation line 9 is closed. The second pressure chamber 28 communicates with the air intake line 6 in the area between the first throttle valve 14 and the second throttle valve 12.

A detailed description of the function of the apparatus is as follows:

If the free flowthrough cross section of the air intake line 6 is enlarged via the first throttle valve 14 at this point, on the basis of an initially controlled status of the described system by means of actuation of the gas pedal 18, then the pressure in the second pressure chamber 28 increases. Under the effect of the compression spring 29, the second throttle valve 12 also opens to some extent, until such time as the underpressure downstream of the second throttle valve 12 has reduced the pressure in the area between the first throttle valve 14 and the second throttle valve 12 to such a point that there is a balance of forces at the adjusting diaphragm 25. Simultaneously the second throttle valve 12 throttles the quantity of the recirculated exhaust gas. When the first throttle valve is completely opened, the second throttle valve 12 is accordingly also completely opened and the mouth 10 of the exhaust recirculation line 9 is completely closed.

Thus in an advantageous manner the exhaust recirculation at full load is entirely precluded in this apparatus, so that the internal combustion engine can produce its maximum power. The second throttle valve 12, as can be understood from the description, follows up the adjustment of the first throttle valve 14, whereupon by way of the spring characteristic of the compression spring 29 influence can still be exerted on the force transmission ratio. As in other known embodiments, in this type of engine control the fresh air quantity is varied and the remnant filling of the cylinders of the engine is accomplished with a quantity of exhaust gas. This is particularly true for the partial-load range.

The measurement of the aspirated air already described and known from other embodiments and the measurement of the injected fuel are provided for the purpose of precise metering of the fuel with the aid of the control device 21, a correction adjustment variable is created which represents depending on its size the deviation of the fuel-air ratio from a desired air number lambda. By means of this control variable, the fuel quantity is made to follow up the fresh air quantity adjusted at the throttle valve 14, by means of adjusting the quantity adjusting member of the fuel injection pump.

Figure 2:
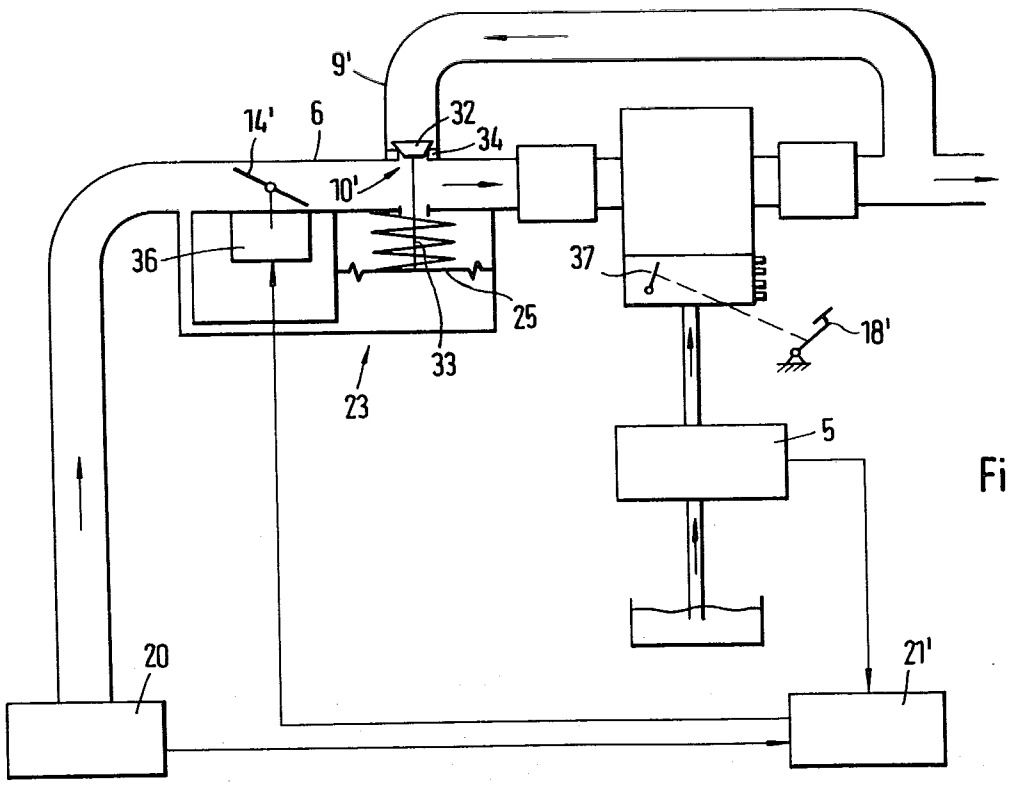
FIG. 2 shows a second exemplary embodiment having a symmetrical throttle valve actuated by means of a rotary magnet.

Essential elements of the apparatus of FIG. 2 correspond to those of the apparatus shown in FIG. 1. Identical elements are given identical reference numerals. Deviating from the embodiment of FIG. 1, a plate valve 32 is provided here instead of the second throttle valve 12 and its valve shaft 33 is firmly connected to the adjusting diaphragm 25. The exhaust recirculation line 9' discharges compactly into the air intake line 6 and at the mouth 10' has an annular cross-piece 34 acting as a valve seat, through the inner opening of which the valve shaft 33 protrudes into the exhaust recirculation line 9'. The valve plate 32 is thus located inside the exhaust recirculation line 9' and is there urged in the closing direction by the exhaust pressure prevailing there. The sealing force of the valve is substantially generated by means of the exhaust gas pressure acting on the valve surface. This embodiment has the advantage that the pneumatic servomotor 23 can be designed as less powerful and that to a greater extent than the preceding example the tightness of the closing at the mouth 10' of the exhaust recirculation line 9' is assured during operation. Disadvantages resulting from soiling of the valve closing element are to be expected much less frequently.

FIG. 2 furthermore shows a different version of the fuel-air quantity control embodied in FIG. 1. Deviating therefrom, a correction signal is generated by the control device 21' which as in the preceding example receives control signals from the fuel meter 5 and the air flow rate meter 20. The correction signal is furhished to a rotary magnet 36 which communicates with the first throttle valve 14'. The fuel injection quantity which is adjusted with the aid of a gas pedal 18', which is connected with an adjusting lever 37 for the quantity adjusting device of the fuel injection pump, acts as the guide variable. Then the supplied fresh air quantity is made to follow up the adjusted fuel quantity with the aid of the control apparatus 21'. As has been described in the preceding example, the plate valve 32 follows up the adjustment movement of the first throttle valve 14'. Naturally in this embodiment the control principle described in FIG. 1 can be used. Because the first throttle valve 14' is balanced as to force, a very small rotary magnet is sufficient for actuating the valve. Its position has the advantage that it is not exposed to soiling by exhaust gas and further can be located at a sufficient distance from points in the intake manifold where high temperatures develop.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. An apparatus for controlling the ratio of air to fuel quantity of an operational mixture to be introduced into the combustion chambers of an internal combustion engine comprising means for controlling an exhaust recirculation quantity having an air flow rate meter which measures the fresh air quantity aspirated by the engine as an actual air quantity, a control means in which the actual air quantity signal is compared with an actual fuel quantity signal relative to a desired air-fuel ratio and furnishing a correction signal corresponding to the result of comparison, in accordance with which the proportion of one or more of the operational substances air, fuel and exhaust gas of the engine may be varied, a symmetrical throttle valve (14', 14') is disposed downstream of the air flow rate meter (20) in the air intake manifold (6) downstream of which an exhaust recirculation line (9, 9') discharges into the intake manifold of the internal combustion engine, the mouth (10, 10') of which exhaust recirculation line (9, 9') is controllable by means of a throttle device (12, 32) actuatable by means of a pneumatic servomotor (23), having an adjusting device (25) exposed on one side to the pressure prevailing downstream of the first throttle valve (14) and urged in the sense of a closing movement of the throttle device by the force of a restoring spring (29) and exposed on the other side to the pressure prevailing upstream of the first throttle valve (14).

2. An apparatus as defined by claim 1, wherein a valve closing element (12, 32) cooperating with the mouth (10, 10') and the valve seat acts as the throttle device.

3. An apparatus as defined by claim 2 wherein the valve closing element has the form of a plate valve (32), which is urged by the pressure in the exhaust recirculation line in the closing direction.

4. An apparatus as defined by claim 2 wherein the exhaust recirculation line (9) protrudes into the air intake manifold (6) and as the throttle device a second throttle valve (12) is disposed in the air intake manifold upstream of the exhaust recirculation line, by means of which valve (12) in its one terminal position the air intake line can be closed and in the other terminal position the mouth (10) of the exhaust recirculation line (9) can be closed by means of the throttle valve portion located downstream of the throttle valve shaft (13).

5. An apparatus as defined by claim 1 wherein the first throttle valve (14) is arbitrarily adjustable and the actual fuel quantity is variable by means of the correction signal.

6. An apparatus as defined by claim 1 wherein the first throttle valve (14') is arbitrarily adjustable by means of an adjusting device (36) in accordance with the correction signal and the actual fuel quantity is arbitrarily adjustable.

* * * * *